US005378209A

United States Patent [19]

Kendrew

[11] Patent Number: 5,378,209

[45] Date of Patent: Jan. 3, 1995

[54] APPARATUS FOR EXERCISING ARMS AND LEGS VERTICALLY

[76] Inventor: Robert J. Kendrew, 2089 Ventana Way, El Cajon, Calif. 92020

[21] Appl. No.: 91,427

[22] Filed: Jul. 15, 1993

[51] Int. Cl.[6] ..... A63B 23/04; A63B 21/00

[52] U.S. Cl. ..... 482/52; 482/37; 482/62

[58] Field of Search ..... 482/51, 52, 53, 62, 482/54, 37

[56] References Cited

U.S. PATENT DOCUMENTS

| | | | |
|---|---|---|---|
| 4,688,791 | 8/1987 | Long | 482/62 |
| 5,039,088 | 8/1991 | Shifferau | 482/51 |
| 5,054,770 | 10/1991 | Bull | 482/53 |
| 5,171,196 | 12/1992 | Lynch | 482/54 |
| 5,256,117 | 10/1993 | Potts et al. | 482/62 |

FOREIGN PATENT DOCUMENTS

| | | | |
|---|---|---|---|
| 0517774 | 2/1931 | Germany | 482/62 |

*Primary Examiner*—Stephen R. Crow
*Attorney, Agent, or Firm*—George J. Rubens

[57] ABSTRACT

Apparatus is designed to exercise the arms and legs in which the user stands upright on foot levers which are supported by a downward pull or a push exerted on hand levers to which the foot levers are independently connected so that the arms and legs move in opposition to each other in substantially upward and downward directions enabling a variety of pullup, pushup, and stepping or climbing exercises to be performed without the need for either weights, friction, or damping devices, and which apparatus can be constructed simply and inexpensively using off the shelf hardware components.

16 Claims, 2 Drawing Sheets

APPARATUS FOR EXERCISING ARMS AND LEGS VERTICALLY

BACKGROUND OF THE INVENTION

This invention related to exercise apparatus, and more particularly to such apparatus that will provide a sustained aerobic workout while exercising the muscles of the legs, arms, and torso, while maintaining the body in a vertically oriented balanced position.

The current trend for improved health has generated a vast number of different exercise devices, many of which can be classified as stair steppers or climbers, all of which equipment are designed to provide an aerobic workout for the user by exercising various muscles of the body.

One such apparatus designed as a stair stepper is disclosed in U.S. Pat. No. 5,129,872 issued on Jul. 14, 1992 to Dalton, et al. This device includes a pair of horizontal foot levers and a pair of vertically extending hand levers all connected by resilient linkage to allow discontinuity between the rotation of the foot levers and the hand levers. A similar device is disclosed in U.S. Pat. No. 5,054,770 issued on Oct. 8, 1991 to Bull.

A simplified climbing exercise device is disclosed in U.S. Pat. No. 5,040,785 issued on Aug. 20, 1991 to Charnitski which discloses an endless chain supported on an inclined track having upper handles and lower foot supports, the chain being fabricated in a figure eight or in a loop to provide different patterns of exercising movements. A similar construction is shown in U.S. Pat. No. 5,169,361 issued on Dec. 8, 1992 to Hsien-Long Hsui.

It should be noted that the above patented apparatus do not provide for independent motion of the legs and arms, and with the arms working in opposition to the weight borne by each of the user's legs. In the prior art devices, the arm levers function only to reposition the foot levers for the next stroke.

SUMMARY OF THE INVENTION

An improved apparatus is designed to exercise the arms and legs of the user simultaneously in opposition to each other in an upward and downward direction with the body remaining in a vertically balanced orientation, and without the need for weights, friction or damping devices. The apparatus includes a rigid frame on which are pivotally mounted two sets of hand levers and foot levers, one set positioned on each right and left hand sides. The hand and foot levers are connected together to oppose each other, with the weight of the user being on the foot levers. The foot and hand levers on each side can be interconnected, or arranged in a cross-over connection so that the hand lever of one set is connected to the foot lever of the other set to simulate a climbing or walking motion. In each of the described combination of levers, it is important that the hand levers directly support the weight of the user's body on the foot levers.

A second set of hand levers mounted below the first set of hand levers can be provided so that the user has the option of pushing down on the lower set of levers rather than pulling down on the upper

OBJECTS OF THE INVENTION

A principle object of this invention is to provide an exercise apparatus in which the arms and legs of a user move in an up and down direction in opposition to each other, with the body remaining in a vertically balanced condition throughout the exercise.

Another important object is to enable the arms to directly support the weight of the user's body through a mechanical advantage.

Still other objects are to provide an apparatus that will exercise the arms and legs in a variety of different ways; to provide an apparatus that can be constructed of simple and off-the-shelf components; and which apparatus is readily portable.

DETAILED DESCRIPTION OF THE INVENTION

Figure 1:
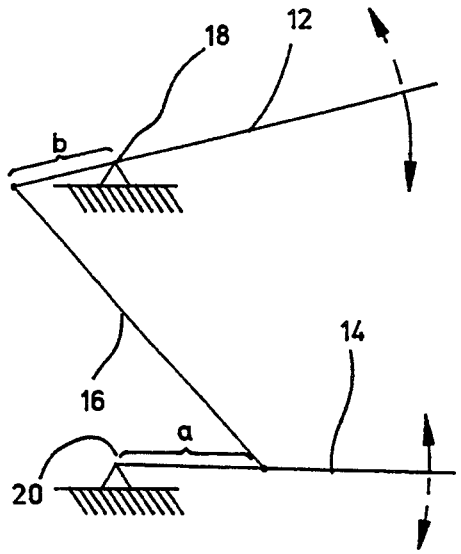
FIG. 1 is a side elevation of a diagrammatic illustration of one side of the novel exercise apparatus illustrating the principle of operation and the motions involved.
Figure 5:
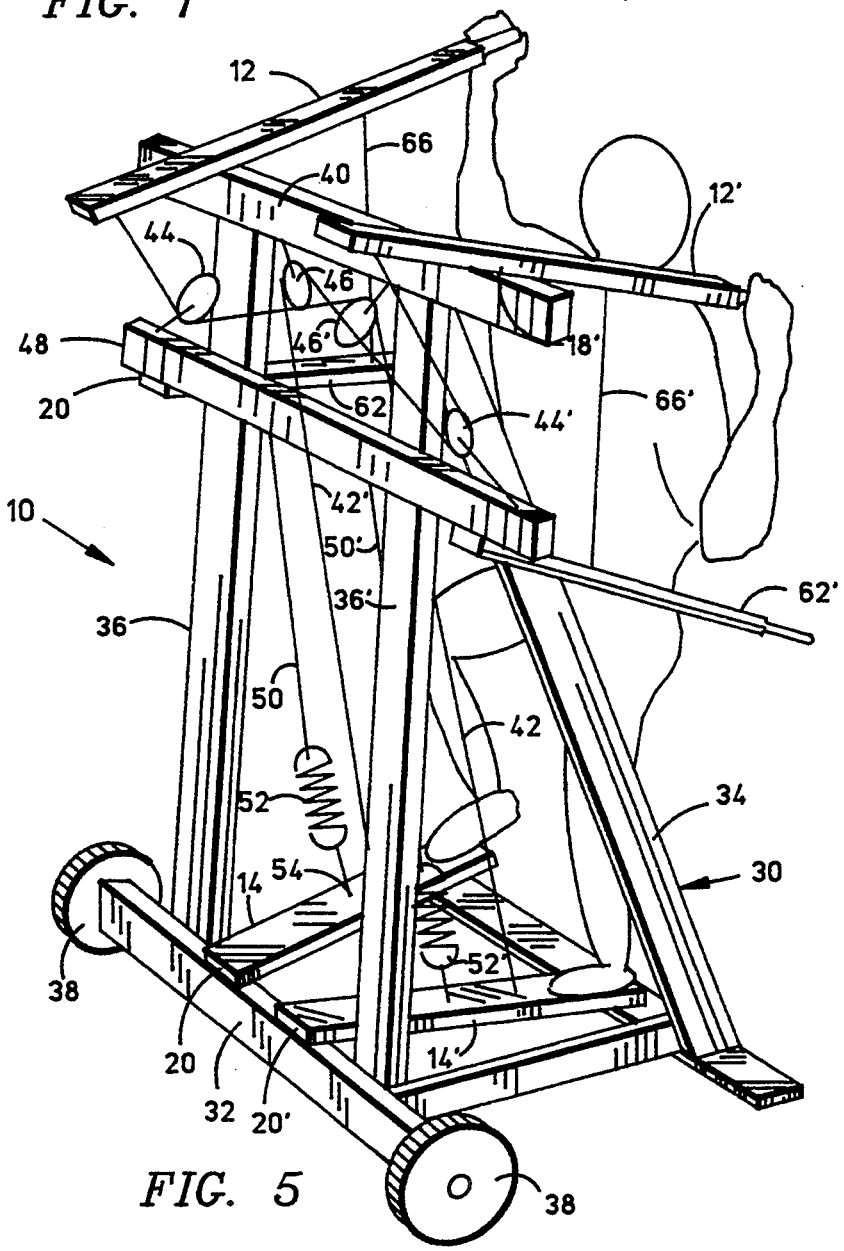
FIG. 5 is a perspective view of the apparatus of FIG. 4 during use.

Referring to the drawings where like reference numerals refer to similar parts throughout the figures, there is shown in FIG. 1 a diagrammatic view of one side of the exercise apparatus 10 for describing the principle of operation. This one side of apparatus 10 comprises a set of levers, namely a hand lever 12 connected to a foot lever 14 by a cable, linkage on the like 16. Hand lever 12 is fulcrumed at a point intermediate its length at a pivot or hinge 18 forming a length "b" between hinge 18 and the connection of cable 16. Foot lever 14 is fulcrumed at its rear end at hinge 20 forming a length "a" between hinge 20 and the connection of the other end of cable 16.

Figures 2, 3, 4:
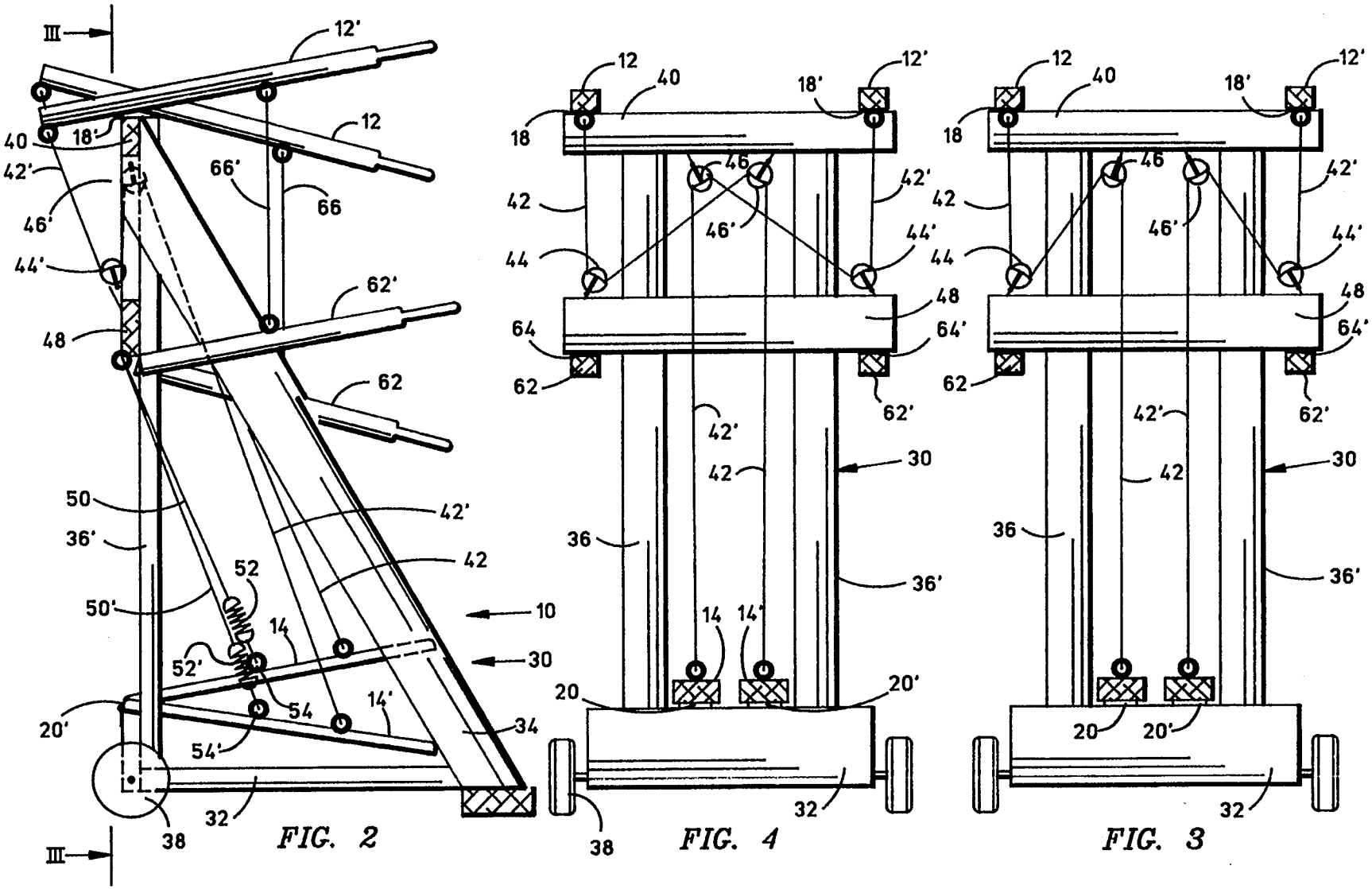
FIG. 2 is a side elevation view of a prototype of the novel exercise apparatus.
FIG. 3 is a rear elevation view of the apparatus of FIG. 2 taken along line III showing the hand lever one side of the apparatus connected to the foot lever on the same side.
FIG. 4 is a rear elevation view of the apparatus also taken along Line III—III OF FIG. 2 showing a variation of the arrangement of the levers, namely, the hand lever on one side of the apparatus being cross-connected with the foot lever on the other side to stimulate a climbing motion.

Length "a" on foot lever 14 is greater than length "b" on hand lever 12 which provides a mechanical advantage for the arms over the legs, as the foot levers support the weight of the user. As will be later described, an additional reduction of the required arm effort can be obtained by suspending the foot levers by springs or the like. Referring to FIGS. 2 to 4, exercise apparatus 10 includes a triangular shaped frame 30 having a base member 32 and a pair of spaced uprights 34 and 36. A set of wheels 38 are mounted on the back side of base 32 to provide the apparatus with ease of mobility.

A pair of foot levers 14 and 14' are hinged at their ends at 20 and 20' to base member 32 between uprights 36 and 36', the foot levers being horizontally spaced apart a distance between the legs of an average user.

Apparatus 10 also includes at least two upper hand levers 12 and 12' horizontally spaced a distance of the shoulders of the average user, the levers being intermediately hinged at 18 and 18' to an upper cross piece 40 of the frame. Upper hand levers 12 and 12' generally extend horizontally and are spaced above foot levers 14 and 14', and at their lowest horizontal position approximately at the shoulders of the average user.

In the species of the invention illustrated in FIG. 3, the rear ends of hand levers 12 and 12' are connected to their corresponding foot levers 14 and 14' on their same side of the frame via lines 42 and 42', respectively, and around a pair of pulleys 44 and 46, and 44' and 46' anchored to a lower cross piece 48 and upper cross piece 40. The lateral offset spacing between the pulleys of the same set will accommodate the lateral offset distance between the foot and hand levers. This offset arrangement of the pulleys will maintain the lines of action in the planes of motion of the foot and hand levers preventing unwanted side forces from acting on the levers.

In the species of the invention illustrated in FIG. 3, each side of the apparatus, namely, the left hand side and the right hand side operate independently of each other. That is, a downward pull on right hand lever 12 will raise the corresponding right foot lever 14 on which the weight of the user bears, causing the right hand and the right leg to work in opposition to each other in a symmetrical manner. Thus, the user's weight on the right foot lever 14 is raised and lowered as the right hand lever is lowered and raised. The same action will occur between the left hand lever 12' and foot lever 14', but independently of the right side.

A reduction in the effort required of each arm to raise its respective leg, that is, to partially support the user's weight on the foot levers, can be achieved by anchoring lines 50 and 50' containing coil springs 52 and 52' at their upper ends to lower cross piece 48 and at 54 and 54' on levers 14 and 14'. Adjustments in the amount of the reduction of the arm effort can be made by changing the location of anchor points 54 and 54' along their respective foot levers.

As has been described with reference to FIG. 3, the connections between the hand levers and the foot levers are so arranged that the left arm and the left leg operate together, as well as the right arm and right leg, each left and right sides being independently operable.

If it is desired that the exercise apparatus 10 simulate a climbing/stepping motion, that is, for example the left arm and the right leg operate together in opposition, the lines and pulleys between the hand and foot levers can be rearranged as illustrated in FIG. 4, with all of the structural components remaining the same.

Thus, in FIG. 4 hand lever 12 is connected to foot lever 14' by line 42 and pulleys 44 and 46'. On the other side of the apparatus, hand lever 12' is connected to foot lever 14 via line 42', pulleys 44' and 46. This cross-over arrangement between the lines and pulleys on each side of the apparatus functions to simulate a climbing/stepping exercise. It should be noted that pulleys 44 and 46' should be laterally offset to avoid interference during use.

Another novel feature of this invention is the provision of a second and lower pair of hand levers 62 and 62' hinged at 64 and 64', respectively, to lower cross piece 48 of free 30. Hand levers 62 and 62' are directly connected to their respective upper hand levers 12 and 12' by lines 66 and 66' or their equivalents. Upper hand levers 12 and 12' are positioned on frame 30 to operate from the general area of the shoulders, and upwardly, so that a downward pull by the user on the upper hand lever from its uppermost position will raise a corresponding foot lever against the weight of the user thereon.

Lower hand levers 62 and 62' are located on the frame to move from the general area of the waist downwardly so that a downward push on hand levers 62 and 62' will raise the corresponding foot levers against the weight of the user. Accordingly, the upper hand levers 12 and 12' provide an exercise which can be considered similar to a pull-up exercise on a horizontal bar, whereas the lower hand levers 62 and 62' provide an exercise similar to push-up exercises from a floor or parallel bars. In either case, both sets of upper and lower hand levers operate in unison, providing a variety of different combinations of exercises to the user.

In summary, the novel apparatus of this invention provides a variety of different pulling and pushing exercises for the arms and legs of the user with the body of the user remaining in a balanced upright position, without requiring a structural change in the apparatus. The exercise can be symmetrical so that the user's weight on the foot levers are raised and lowered as the hand levers on the same side of the apparatus are lowered and raised together in unison. Or, the exercise can be unsymmetrical as the user alternately raises and lowers the hang and foot levers in a coordinated rhythm that approximates a stepping/climbing motion. In either case the body of the user remains in an upright position throughout the exercise. The provision of two mechanically connected hand levers generally located at the shoulders and waist of the user gives the user an option, in the same apparatus, of a pushing or a pulling muscle exercise.

I claim:

1. An apparatus for exercising the arms and legs in a generally upward and downward direction with the user in a balanced, upright orientation, comprising:

a frame;

two sets of levers horizontally spaced, one set on each side of the frame, each set including a foot lever and at least one hand lever to comply with the two sets of levers, the levers in each set pivotally mounted to the frame in vertically spaced relationship;

means connecting said foot and hand levers so that a downward movement of a foot lever will cause an upward movement of a hand lever, and a downward movement of a hand lever will cause an upward movement of a foot lever;

said levers extending generally horizontally so that when actuated above and below the horizontal, the respective arms and legs of a user move generally upwardly and downwardly whereby the arms and legs can be exercised in opposition to each other with the downward force exerted on a foot lever being opposed by an upward force exerted on the hand lever to which it is connected, whereby the user's weight is continuously supported by both the arms and legs, and the user's body is maintained in a balanced upright position throughout the exercise.

2. The apparatus of claim 1 wherein the hand levers are pivotally mounted on the frame so that they extend generally above the shoulders of the user and are operated by a downward pull.

3. The apparatus of claim 1 wherein the hand levers are pivotally mounted on the frame so that they extend generally below the shoulders of the user and are operated by a downward push.

4. The apparatus of claim 1 wherein the hand levers of both claim 2 and claim 3 are connected together.

5. The apparatus of claim 1 wherein the hand and foot levers of each set are connected together.

6. The apparatus of claim 1 wherein the hand lever of one set is connected to the foot lever of the other set.

7. The apparatus of claim 1 wherein each set includes two hand levers interconnected so that they operate together with a foot lever.

8. The apparatus of claim 7 wherein only one hand lever in each set is directly connected to a foot lever.

9. The apparatus of claim 1 wherein the hand and foot levers are connected by means of a line and pulley.

10. The apparatus of claim 1 wherein the levers are pivotally mounted to the frame by hinges.

11. The apparatus of claim 1 wherein each of the foot levers is suspended from the frame by a spring to partially support the user's weight thereby reducing the downward force on each hand lever that is required to raise the interconnected foot lever.

12. The apparatus of claim 1 wherein said frame is provided with a set of wheels to facilitate mobility.

13. The apparatus of claim 1 wherein the pivotal connections of the hand and foot lever in each set is so arranged that the vertical stroke of movement of the hand lever is greater than the vertical stoke of movement of the foot lever to correspond to the normal range of vertical movement of the arms and legs of the user during the exercise.

14. The apparatus for exercising the arms and legs in a generally up and down movement comprising:

a frame;

two sets of levers horizontally spaced one set located on each side of the frame, each set including two hand levers and a foot lever, each lever pivotally mounted on the frame;

one of said hand levers in each set extending generally and horizontally above the shoulders of the user and operable by a pull, and the other of said hand levers in each set extending generally horizontally below the shoulders and operable by a push;

means connecting the hand levers in each set to a foot lever so that when actuated the arms and legs of the user move generally upwardly and downwardly;

whereby the arms and legs can be exercised in opposition to each other with the hand levers supporting the weight of the user on the foot levers, maintaining the body of the user in a balanced upright position throughout the exercise.

15. The apparatus of claim 14 wherein each of said foot levers are anchored to the frame by means of a spring to partially support the user's weight to reduce the required force on the hand levers to raise the foot levers.

16. The apparatus of claim 14 wherein the hand levers of one set are connected to the foot lever of the other set so that when actuated the arms and legs move generally upwardly and downwardly to simulate a climbing motion.

* * * * *

UNITED STATES PATENT AND TRADEMARK OFFICE

CERTIFICATE OF CORRECTION

PATENT NO. : 5,378,209

DATED : January 3, 1995

INVENTOR(S) : Robert J. Kendrew

It is certified that error appears in the above-identified patent and that said Letters Patent is hereby corrected as shown below:

Column 2, line 68, complete the sentence by adding --levers.-- after "upper".
Column 4, (claim 1) lines 40 & 41, delete "to comply with the two sets of of levers"
Column 2, (claim 1) line 55, change "upward" to --downward--

Signed and Sealed this

Twenty-eight Day of March, 1995

*Attest:*

Bruce Lehman

BRUCE LEHMAN

*Attesting Officer*

*Commissioner of Patents and Trademarks*